United States Patent [19]

Erickson

[11] 4,281,962

[45] Aug. 4, 1981

[54] HIGH PRESSURE CENTRIFUGAL PUMP

[75] Inventor: John W. Erickson, Huntington Beach, Calif.

[73] Assignee: Kobe, Inc., City of Commerce, Calif.

[21] Appl. No.: 23,206

[22] Filed: Mar. 23, 1979

[51] Int. Cl.[3] ..... F04B 25/08

[52] U.S. Cl. ..... 415/89

[58] Field of Search ..... 415/88, 89; 417/84, 417/89

[56] References Cited

U.S. PATENT DOCUMENTS

| | | | |
|---|---|---|---|
| 3,093,080 | 6/1963 | Tarifa et al. | 415/89 X |
| 3,384,024 | 5/1968 | King | 415/89 |
| 3,817,659 | 6/1974 | Erickson | 415/89 X |

*Primary Examiner*—Billy J. Wilhite

*Attorney, Agent, or Firm*—William C. Norvell, Jr.

[57] ABSTRACT

A centrifugal pump is provided for generating a relatively high pressure fluid discharge. The pump includes a stationary, enclosed rotor housing having a fluid inlet and a fluid outlet. A rotor assembly is rotatably supported in the rotor housing. The rotor assembly includes a chamber having a radial passage formed in one end thereof for fluid communication between the fluid inlet and a peripheral portion of the chamber. A drive shaft is rotatably supported in the rotor assembly and has a discharge tube formed therein with one end in fluid communication with the fluid outlet. A pair of hollow, radially extending pickup arms are attached to the drive shaft. Each pickup arm has an inlet positioned proximate the peripheral portion of the chamber and an outlet in fluid communication with the other end of the discharge tube. A drive means rotates the rotor assembly and the drive shaft in opposite directions with respect to each other and the rotor housing whereby a relatively high fluid pressure is generated at the fluid outlet.

14 Claims, 1 Drawing Figure

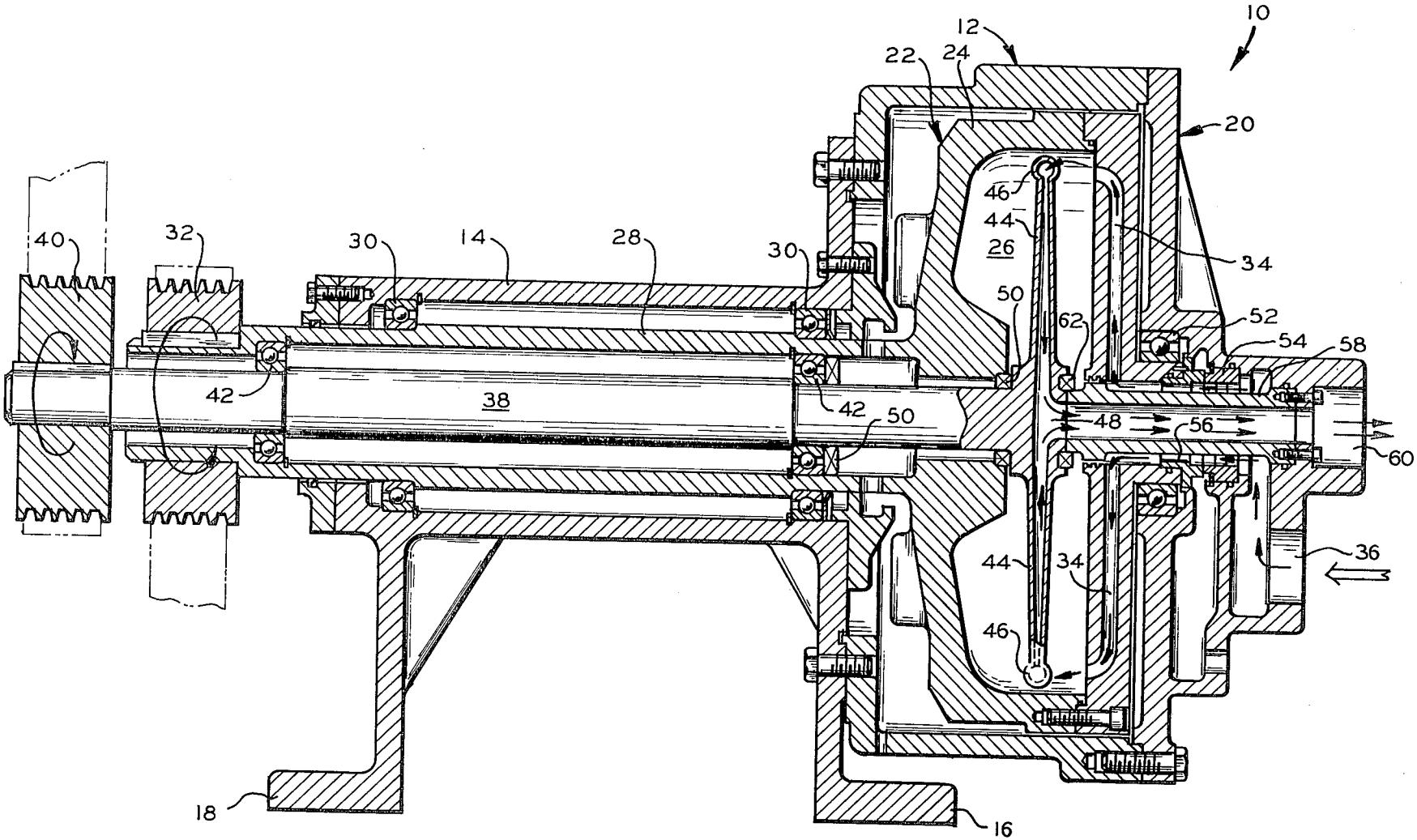
10
20
34
52
54
58
60
36
56
48
62
34
46
44
26
50
44
46
12
24
22
16
50
42
30
28
14
38
30
42
32
40
18

HIGH PRESSURE CENTRIFUGAL PUMP

BACKGROUND OF THE INVENTION

1. Field of the Invention

The present invention relates generally to centrifugal pumps for fluids and more particularly to centrifugal pumps of the type having a rotatable casing which impels the subject fluid to a fluid collection and discharge device within the pump casing. An example of such a pump is disclosed in U.S. Pat. No. 3,384,024 issued May 21, 1968, to William L. King.

2. Description of the Prior Art

Presently, there are many types of fluid pumps available in the market place including the above-described pump which is of the centrifugal type. Many of the prior art pumps are not particularly efficient for pumping fluids at fairly high pressures and, if they are adaptable to such service, require high horsepower to perform the function. Also, typical high pressure delivery pumps require a number of expensive seals which are replaced at regular intervals. Multistage pumps, which are larger, more complex and more expensive, have been used to deliver water and water containing suspended solids in appreciable quantities at high pressures. These pumping systems also use expensive seals which require replacement at regular intervals. Also, most pumps which operate at high pressures are subject to greater stresses on the housings, casings, etc., than lower pressure pumps which lowers the service life of this pump. Thus, there is a need in the market place for a simple, single stage pump capable of pumping water or water with suspended solids efficiently at high pressures and in relatively large volumes with greater efficiency and lower overall cost than the previous pumping systems.

SUMMARY OF THE INVENTION

The present invention concerns a centrifugal pump for generating a relatively high pressure fluid discharge. The pump includes a stationary, enclosed rotor housing having a fluid inlet and a fluid outlet. A rotor assembly is rotatably supported in the rotor housing. The rotor assembly includes a chamber which is rotated about a central axis and has a radial passage formed in one end wall for fluid communication between the fluid inlet and a peripheral portion of the chamber.

A drive shaft is rotatably supported in the rotor assembly for rotation on a common axis. The drive shaft has a discharge tube formed therein with one end in fluid communication with the fluid outlet. A pair of radially extending hollow pickup arms are attached to the drive shaft in the chamber. Each pickup arm has an inlet positioned proximate the peripheral portion of the chamber and an outlet in fluid communication with the other end of the discharge tube.

Drive means rotate the rotor assemby and the drive shaft in opposite directions with respect to each other and the rotor housing. The fluid being pumped is accelerated from the fluid inlet through the radial passage under centrifugal force. The pickup arms collect the fluid in the peripheral portion of the chamber with a further increase in velocity proportional to the square of the difference in the rotational speeds of the rotor assembly and the pickup arms. Thus, the pump increases the fluid pressure to a relatively high value as it is discharged through the discharge tube and the fluid outlet.

BRIEF DESCRIPTION OF THE SINGLE DRAWING

The drawing is a sectional, elevational view of a high pressure centrifugal pump embodying the features of the present invention.

DESCRIPTION OF THE PREFERRED EMBODIMENTS

Referring to the drawing, there is shown a single stage, centrifugal pump which accepts an incoming fluid, such as water, hydraulic fluid, oil and the like, and pumps the fluid at a pressure substantially higher than presently available from such centrifugal pumps. The pump accelerates the fluid through acceleration passages into a rotating chamber where it is collected by pickup arms which rotate within the chamber, but rotate in a direction opposite to that of the chamber.

The pump is generally indicated by the reference numeral 10 and includes a cylindrical rotor housing 12 open at one end and terminating in an elongated cylindrical bearing support 14 at the other end. The housing 12 is mounted on a pair of flanged supports, a support 16 attached to the main body of the housing and a support 18 attached to the bearing support 14. A circular end bell 20 is attached to the housing 12 to sealingly close the open end.

A rotor assembly 22 is disposed within the rotor housing 12 and includes a generally cylindrical body 24 forming a cylindrical chamber 26. At one end of the body 24, there is formed a tubular extension 28 which is rotatably supported in the bearing support 14 by a pair of bearings 30. The tubular extension 28 extends through an end wall of the bearing support 14 and has a drive means attached thereto such as a pulley 32 driven from an electric motor (not shown). The other end of the chamber 26 terminates in a wall having radial passages 34 formed therein. The end bell 20 has a fluid inlet 36 which is in fluid communication with the inner end of each of the passages 34. The outer end of each of the passages 34 is positioned proximate a peripheral portion of the chamber 26. Fluid entering the inlet 36 is accelerated through the passages 34 by centrifugal force and into the chamber 26.

A drive shaft 38 extends through the tubular extension 28 and has a drive means attached thereto such as a pulley 40 driven from an electric motor (not shown). The drive shaft 38 is rotatably supported in the extension 28 by a pair of bearings 42. The drive shaft extends into the chamber 26 and terminates in a pair of hollow pickup arms 44. The pickup arms extend radially from the drive shaft 38 and each terminates in angled pickup head 46 positioned proximate the peripheral portion of the chamber 26. Each pickup arm 44 is in fluid communication at one end with an inlet in the pickup head and at the other end with a common circular outlet 48. A pair of seals 50 are utilized to seal the drive shaft 38 to the rotor body 24 and the tubular extension 14 to prevent the leakage of fluid from the chamber 26 into the bearings 42.

The rotor assembly 22 may be, but is not required to be, rotatably supported in the end bell 20 by a bearing 52. A seal 54 is utilized to prevent the leakage of fluid from the inlet 36 into the bearing 52. The inlet 36 is connected to the radial passages 34 by a tubular passage 56 formed in the end bell 20. A stationary discharge tube 58 is attached to the end bell 20 and connects the pickup arm outlet 48 with a fluid outlet 60 formed in the end bell. A seal 62 is utilized to prevent leakage into the chamber 26 at the pickup arm outlet/discharge tube interface.

OPERATION

In operation, and as viewed from the pulley end of the drive shaft 38, the drive shaft is rotated in a counterclockwise direction and the rotor assembly 22 is rotated in a clockwise direction about a common axis. Fluid entering the chamber 26 from the passages 34 is collected at the pickup heads 46 and is forced through the pickup arms 44 to the outlet 48. The fluid then is forced through the discharge tube 58 to the fluid outlet 60.

The pressure of the fluid at the outlet 60 is proportional to the relative velocity of the pickup heads 46 through the fluid in chamber 26. If the drive shaft 38 is rotated at the same speed as the rotor assembly 22, the total velocity will be doubled and, when squared, will be four times the velocity in a centrifugal pump in which only the rotor assembly rotates. Thus, the present invention obtains a four-fold increase in the fluid discharge pressure without substantially increasing the stresses created in the pump. For example, at a typical speed of 3,500 rpm, the pressure can be increased from approximately 600 p.s.i. to approximately 2,400 p.s.i.

In summary, the present invention concerns a centrifugal pump for pumping fluids under relatively high pressure comprising an enclosed rotor housing having an inlet means and an outlet means for the fluid being pumped and a rotor assembly rotatably supported in the rotor housing and having a chamber connected to the rotor housing inlet. The pump includes a fluid pickup means rotatably supported in the rotor assembly chamber for collecting the fluid from the chamber and discharging the fluid at the outlet. When the rotor assembly and the fluid pickup means are rotated in opposite directions, the fluid is discharged at the outlet at a relatively high pressure.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A centrifugal pump for pumping fluids under relatively high pressure comprising: a rotor assembly supported for rotation about an axis and defining a chamber; fluid inlet means in fluid communication with said chamber; fluid pickup means supported for rotation about said axis in said chamber for collecting fluid from said chamber; and outlet means in fluid communication with said pickup means for discharging said fluid at the relatively high pressure when said rotor assembly and said pickup means are rotated in opposite directions.

2. A pump according to claim 1 wherein said rotor assembly includes a radial passage formed in one end wall of said chamber for providing fluid communication between said inlet means and a peripheral portion of said chamber and increasing the velocity of the fluid flow into said chamber as said rotor assembly is rotated.

3. A pump according to claim 2 wherein said fluid pickup means includes a drive shaft rotatably supported by said rotor assembly and having a discharge tube formed therein with one end connected to said outlet means; and a pair of hollow pickup arms each having an inlet formed at one end proximate the periphery of said chamber and the other end in fluid communication with the other end of said discharge tube.

4. A pump according to claim 1 including an enclosed rotor housing for rotatably supporting said rotor assembly and said pickup means and wherein said fluid inlet and outlet means include a fluid inlet and outlet respectively formed in said rotor housing.

5. A pump according to claim 1 including drive means for rotation said rotor assembly and said fluid pickup means in opposite directions.

6. A centrifugal pump for pumping fluids under relatively high pressure comprising: an enclosed rotor housing having an inlet and an outlet for the fluid being pumped; a rotor assembly rotatably supported in said rotor housing and having a chamber in fluid communication with said inlet; and fluid pickup means including at least two pickup arms radially extending from the axis of rotation of said fluid pickup means and in fluid communication between said chamber and said outlet whereby, when said rotor assembly and said pickup arms are rotated in opposite directions about the same axis, the fluid is discharged at said outlet at a relatively high pressure.

7. A pump according to claim 6 wherein said rotor assembly includes a radial passage formed in one end wall of said chamber for fluid communication between said inlet and a peripheral portion of said chamber and wherein each of said pickup arms has an inlet at one end positioned proximate the periphery of said chamber.

8. A pump according to claim 7 wherein said fluid pickup means includes a drive shaft rotatably supported by said rotor assembly and having a discharge tube formed therein with one end connected to said outlet and wherein said pickup arms are attached to said drive shaft and each of said pickup arms has an outlet at the other end in fluid communication with the other end of said discharge tube.

9. A pump according to claim 6 wherein said relatively high pressure is about 2,400 pounds per square inch at about 3,500 revolutions per minute.

10. A centrifugal pump for pumping fluids under relatively high pressure comprising: a rotor assembly supported for rotation about an axis and defining a chamber; fluid inlet means in fluid communication with said chamber; fluid pickup means including at least two hollow pickup arms supported for rotation about said axis in said chamber for collecting fluid from said chamber; and outlet means in fluid communication with said pickup arms for discharging said fluid at the relatively high pressure when said rotor assembly and said pickup arms are rotated in opposite directions.

11. A pump according to claim 10 wherein said pickup arms are mounted on a drive shaft rotatably supported by said rotor assembly, said drive shaft having a discharge tube formed therein for fluid communication between said pickup arms and said outlet means.

12. A pump according to claim 10 wherein said rotor assembly includes a radial passage formed in one end wall of said chamber in fluid communication between said inlet means and the periphery of said chamber and wherein said pickup arms each have a fluid inlet proximate the periphery of said chamber.

13. A pump according to claim 10 including drive means for rotating said rotor assembly and said fluid pickup arms in opposite directions.

14. A pump according to claim 13 including an enclosed rotor housing for rotatably supporting said rotor assembly and said fluid pickup means and wherein said fluid inlet and outlet means include a fluid inlet and outlet respectively formed in said rotor housing.

* * * * *